US009975217B2

(12) United States Patent
Nishimura

(10) Patent No.: US 9,975,217 B2
(45) Date of Patent: May 22, 2018

(54) SCATTERING PLATE, GRINDING WHEEL, AND GRINDING DEVICE

(71) Applicant: SUMCO TECHXIV CORPORATION, Nagasaki (JP)

(72) Inventor: Yoshinobu Nishimura, Tokyo (JP)

(73) Assignee: SUMCO TECHXIV CORPORATION, Nagasaki (JP)

( * ) Notice: Subject to any disclaimer, the term of this patent is extended or adjusted under 35 U.S.C. 154(b) by 34 days.

(21) Appl. No.: 14/902,738

(22) PCT Filed: Apr. 25, 2014

(86) PCT No.: PCT/JP2014/061751
§ 371 (c)(1),
(2) Date: Jan. 4, 2016

(87) PCT Pub. No.: WO2015/004973
PCT Pub. Date: Jan. 15, 2015

(65) Prior Publication Data

US 2016/0176020 A1 Jun. 23, 2016

(30) Foreign Application Priority Data

Jul. 8, 2013 (JP) ..... 2013-142754

(51) Int. Cl.
*B24B 55/02* (2006.01)
*B24D 5/10* (2006.01)
(Continued)

(52) U.S. Cl.
CPC ..... *B24D 5/10* (2013.01); *B24B 57/02* (2013.01); *B24D 5/02* (2013.01); *B24D 7/10* (2013.01); *B24D 7/18* (2013.01)

(58) Field of Classification Search
CPC ..... B24B 57/02; B24B 55/02; B24D 5/10; B24D 5/02; B24D 7/00; B24D 7/10
(Continued)

(56) References Cited

U.S. PATENT DOCUMENTS

2003/0054648 A1 3/2003 Jeong
2007/0049182 A1* 3/2007 Burgess ..... B23F 15/06 451/51

FOREIGN PATENT DOCUMENTS

CN 202785722 3/2013
JP 6-23674 2/1994
(Continued)

OTHER PUBLICATIONS

Office Action issued in China Counterpart Patent Appl. No. 201480038951.6, dated Aug. 26, 2016 , along with an English translation thereof.
(Continued)

*Primary Examiner* — Robert Rose
(74) *Attorney, Agent, or Firm* — Greenblum & Bernstein, P.L.C.

(57) ABSTRACT

A diffusion plate includes a plate member facing an opening end of a supply pipe with a thickness direction thereof substantially parallel with a supply direction of a supply fluid. The plate member is rotatable around a rotation axis substantially parallel with the thickness direction and has a diffusion hole, penetrating in the thickness direction at a position other than a rotation center of the plate member. The diffusion hole has a wall surface defined at a rear side in a rotation direction and has a first wall surface end defined in a facing surface facing the supply pipe, at a rearmost in the rotation direction and a second wall surface end defined in a non-facing surface at a rearmost in the rotation direction. The wall surface is inclined with the first wall surface end being at a front side of the second wall surface end in the rotation direction.

5 Claims, 8 Drawing Sheets

(51) Int. Cl.

| | |
|---|---|
| ***B24D 7/10*** | (2006.01) |
| ***B24D 7/18*** | (2006.01) |
| ***B24B 57/02*** | (2006.01) |
| ***B24D 5/02*** | (2006.01) |

(58) Field of Classification Search
USPC ..... 451/28, 57, 269, 268, 262, 451, 53, 178, 451/450
See application file for complete search history.

(56) References Cited

FOREIGN PATENT DOCUMENTS

| | | |
|---|---|---|
| JP | 6-99360 | 4/1994 |
| JP | 6-83260 | 11/1994 |
| JP | 9-38866 | 2/1997 |
| JP | 4921430 | 2/2012 |
| TW | 201124232 | 7/2011 |

OTHER PUBLICATIONS

International Search Report received in PCT/JP2014/061751, dated Jun. 17, 2014.
Office Action issued in Taiwan Counterpart Patent Appl. No. 103111654, dated Jan. 5, 2016 , along with an English translation thereof.
International Preliminary Report on Patentability for PCT/JP2014/061751, dated Jan. 12, 2016.
Foreign Office Action issued in Japan patent application No. 2013-142754 dated Dec. 6, 2016 , along with an English translation thereof.

* cited by examiner

SCATTERING PLATE, GRINDING WHEEL, AND GRINDING DEVICE

TECHNICAL FIELD

The present invention relates to a diffusion plate, a grinding wheel, and a grinding machine.

BACKGROUND ART

Typical cup-shaped grinding wheels for grinding a workpiece have been known. Cup-shaped grinding wheels usually include a grinding stone in an annular shape attached to a wheel base. The grinding stone includes a plurality of chips arranged along an outer circumferential direction of the annular shape at predetermined intervals. Such a grinding wheel is attachable to a grinding machine, which includes a supply pipe for supplying a grinding fluid. The grinding wheel is disposed to face an opening end of the supply pipe.

In a grinding process, the grinding wheel needs to be replaced due to wear of the grinding stone resulting from grinding of a workpiece. Accordingly, an increase in the lifetime of the grinding wheel is demanded to suppress an increase in costs.

CITATION LIST

Patent Literature(s)

Patent Literature 1: Japanese Patent No. 4921430
Patent Literature 2: JP-A-9-38866

SUMMARY OF THE INVENTION

Problem(s) to be Solved by the Invention

In order to increase the lifetime of the grinding wheel, a height of the grinding stone may be increased. However, when the workpiece is ground with the grinding stone having an increased height, a required amount of a grinding fluid fails to be supplied to a wafer ground surface due to an increase in the distance to the wafer ground surface. The use of the grinding stone having an increased height for grinding thus causes a shortage of the supply of the grinding fluid and, consequently, increases a wear volume of the grinding stone per wafer.

Accordingly, in order to suppress an increase in the wear volume of the grinding stone accompanying an increase in the height of the grinding stone, for instance, a supply flow rate of the grinding fluid may be adjusted in accordance with the wear volume of the grinding stone (see Patent Literature 1).

However, a technique disclosed in Patent Literature 1 requires a complicated process for adjusting the supply flow rate of the grinding fluid.

Alternatively, a technique of supplying the grinding fluid to the wafer ground surface using a centrifugal force generated by rotating a diffusion plate including radially arranged impellers may be employed (see Patent Literature 2). However, this technique requires the impellers, which complicate the structure of the diffusion plate.

In view of the above, a grinding machine using a technique of diffusing a supply fluid, such as a grinding fluid, through the supply pipe is desired to have a simple arrangement allowing for an increase in a diffusion distance of the supply fluid in a supply direction.

An object of the invention is to provide a diffusion plate, a grinding wheel and a grinding machine that allow an increase in a diffusion distance of a supply fluid in a supply direction while suppressing an increase in costs.

Means for Solving the Problem(s)

According to a first aspect of the invention, a diffusion plate configured to diffuse a supply fluid supplied through a supply pipe includes a plate member configured to face an opening end of the supply pipe with a thickness direction of the plate member being substantially parallel with a supply direction of the supply fluid, the plate member being rotatable around a rotation axis substantially parallel with the thickness direction, in which the plate member is provided with a diffusion hole, through which the supply fluid is to be passed, disposed at a position other than a rotation center of the plate member, the diffusion hole has a first wall surface defined at a rear side in a rotation direction of the plate member, the first wall surface having a rear first wall surface end defined in a facing surface of the plate member, which faces the supply pipe, at a rearmost in the rotation direction and a rear second wall surface end defined in a non-facing surface of the plate member at a rearmost in the rotation direction, and the first wall surface is inclined with the rear first wall surface end being at a front side of the rear second wall surface end in the rotation direction.

Here, any fluid usable for, for instance, grinding, washing and/or chemical reaction is usable as the supply fluid as long as it can be supplied through the supply pipe. The supply pipe may be rotatable at the same speed as that of the diffusion plate or at a different speed, or may not be rotatable.

In the above aspect, the diffusion hole of the diffusion plate has the first wall surface defined at the rear side in the rotation direction, the first wall surface having the first wall surface end defined in the facing surface of the plate member, which faces the supply pipe, at the rearmost in the rotation direction and the second wall surface end defined in the non-facing surface of the plate member at the rearmost in the rotation direction, the first wall surface being inclined such that the first wall surface end is at the front side of the second wall surface end in the rotation direction.

When such a diffusion plate is rotated at a position facing the opening end of the supply pipe, the supply fluid discharged through the supply pipe enters the diffusion hole. At this time, the supply fluid, which has come into contact with the first wall surface of the diffusion hole defined at the rear side in the rotation direction, is inferred to receive a force in the supply direction as the inclined first wall surface is moved forward in the rotation direction of the diffusion plate. The diffusion distance of the supply fluid can thus be increased as compared with that of a typical device simply by inclining the first wall surface of the diffusion hole as described above without the necessity of adjusting the supply flow rate of the supply fluid.

In the above aspect, it is preferable that the diffusion hole has a second wall surface defined at a front side in the rotation direction, the second wall surface having a front first wall surface end defined in the facing surface at a forefront in the rotation direction and a front second wall surface end defined in the non-facing surface at a forefront in the rotation direction, and the second wall surface is inclined with the front first wall surface end being at a front side of the front second wall surface end in the rotation direction.

In the above aspect, the diffusion hole of the diffusion plate also has the second wall surface defined at the front side in the rotation direction, the second wall surface having the first wall surface end defined in the facing surface at the forefront in the rotation direction and the second wall surface end defined in the non-facing surface at the forefront in the rotation direction, the second wall surface being inclined such that the first wall surface end is at the front side of the second wall surface end in the rotation direction.

Such an inclination of the second wall surface at the front side in the rotation direction allows the supply fluid, which is discharged into the diffusion hole from the supply pipe, to be directed rearward in the rotation direction. Thus, an amount of the supply fluid receiving a force in an ejection direction can be increased by the wall surface of the diffusion hole at the rear side in the rotation direction and, consequently the diffusion distance of the supply fluid in the ejection direction.

In the above aspect, it is preferable that the diffusion hole of the plate member includes a plurality of diffusion holes, and the plurality of diffusion holes are arranged at regular intervals on a circumference of an imaginary circle defined around the rotation center of the plate member.

In the above aspect, the plurality of diffusion holes are arranged at regular intervals on the circumference of the imaginary circle defined around the rotation center of the plate member.

Such a plurality of through-holes arranged at regular intervals on the circumference of the imaginary plane allow even diffusion of the supply fluid in any circumferential direction.

In the above aspect, it is preferable that the diffusion hole has an opening defined in the facing surface, and an opening edge of the supply pipe overlaps with the opening.

For instance, when the supply pipe is rotatable, the supply fluid is directed toward an opening edge of the supply pipe while being pressed against an inner wall surface of the supply pipe by a centrifugal force of the rotation of the supply pipe applied to the supply fluid. Thus, when the entire opening(s) of the diffusion hole(s) defined in the facing surface is present inside the opening of the supply pipe without any overlap of the opening edge(s) of the diffusion hole(s) defined in the facing surface with the opening edge of the supply pipe, the supply fluid, which is pressed against the opening edge of the supply pipe along the entire circumference of the supply pipe, is inadvertently left in the supply pipe without entering the diffusion hole(s).

In contrast, when the opening edge of the supply pipe overlaps with the opening(s) of the diffusion hole(s) defined in the facing surface, i.e., a part of the opening edge(s) of the diffusion hole(s) defined in the facing surface intersects with a part of the opening edge of the supply pipe, as in the above aspect, the supply fluid, which is pressed against the opening edge of the supply pipe, can be reliably directed into the diffusion hole(s) without being left in the supply pipe. Such an arrangement can suppress a reduction in the diffusion amount of the supply fluid.

According to a second aspect of the invention, a grinding wheel configured to grind a workpiece using a grinding fluid supplied through a supply pipe includes: a substantially plate-shaped wheel base configured to face an opening end of the supply pipe with a thickness direction of the wheel base being substantially parallel with a supply direction of the supply fluid, the wheel base being rotatable around a rotation axis substantially parallel with the thickness direction; and a grinding stone annularly projecting from a non-facing surface of the wheel base configured not to face the supply pipe, the grinding stone being configured to be pressed against the workpiece, in which the wheel base is provided with a diffusion hole, through which the supply fluid is to be passed, disposed at a position other than a rotation center of the wheel base, the diffusion hole has a wall surface defined at a rear side in a rotation direction of the wheel base, the wall surface having a rear first wall surface end defined in a facing surface of the wheel base, which faces the supply pipe, at a rearmost in the rotation direction and a rear second wall surface end defined in the non-facing surface of the wheel base at a rearmost in the rotation direction, and the wall surface is inclined with the rear first wall surface end being at a front side of the rear second wall surface end in the rotation direction.

The grinding wheel of the above aspect includes the wheel base provided with the diffusion hole as described above. The diffusion distance of the grinding fluid can thus be increased as compared with that of a typical device simply by inclining the wall surface of the diffusion hole as described above without the necessity of adjusting the supply flow rate of the grinding fluid. Further, a required amount of the grinding fluid can be supplied to the workpiece irrespective of whether or not the height of the grinding stone of the grinding wheel is large, thereby preventing an increase in the grinding stone wear volume per workpiece. The grinding wheel can thus have a longer lifetime.

According to a third aspect of the invention, a grinding machine includes: a supply pipe; the diffusion plate configured to diffuse a supply fluid supplied through the supply pipe; and a grinding wheel configured to grind the workpiece using the grinding fluid diffused by the diffusion plate. Such a grinding machine is hereinafter occasionally referred to as a first grinding machine.

According to a fourth aspect of the invention, a grinding machine includes: a supply pipe; and the grinding wheel configured to grind a workpiece using a grinding fluid supplied through the supply pipe. Such a grinding machine is hereinafter occasionally referred to as a second grinding machine.

The first and second grinding machines of the above aspects, in which the wall surface of the diffusion hole is simply inclined as described above, can increase the diffusion distance of the grinding fluid as compared with a typical device without the necessity of adjusting the supply flow rate of the grinding fluid. The first and second grinding machines also allow an increase in the lifetime of the grinding wheel as described above. The first and second grinding machines also allow the grinding fluid to reliably reach the workpiece without the necessity of adjusting the supply flow rate of the grinding fluid irrespective of whether or not the height of the grinding stone is large, which results in saving the grinding fluid and in reducing production costs.

The first grinding machine, which provides the above advantages, includes the diffusion plate independent of the grinding wheel. The first grinding machine can thus be provided simply by attaching the diffusion plate to a typical grinding machine. Further, each of the diffusion plate and the grinding wheel can be easily independently replaced or subjected to maintenance.

In contrast, the second grinding machine includes the grinding wheel provided with a diffusion hole. Such a grinding wheel is easily detachable/attachable for replacement or maintenance.

BRIEF DESCRIPTION OF DRAWING(S)

Figure 7:
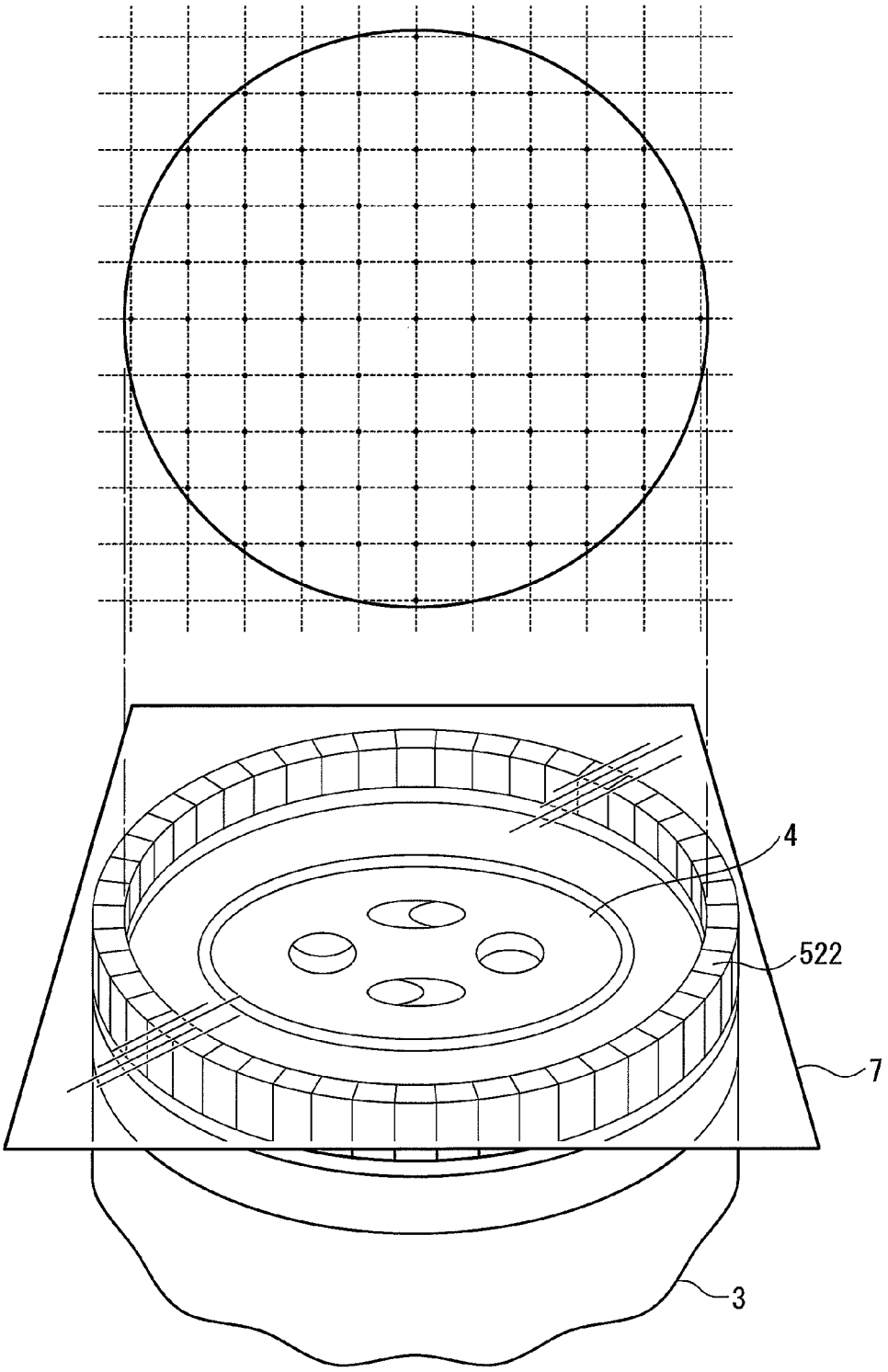

FIG. 7 schematically shows an experimental method for demonstrating a diffusion state of a grinding fluid diffused by the diffusion plate according to the invention in Example 3.

Figure 8:
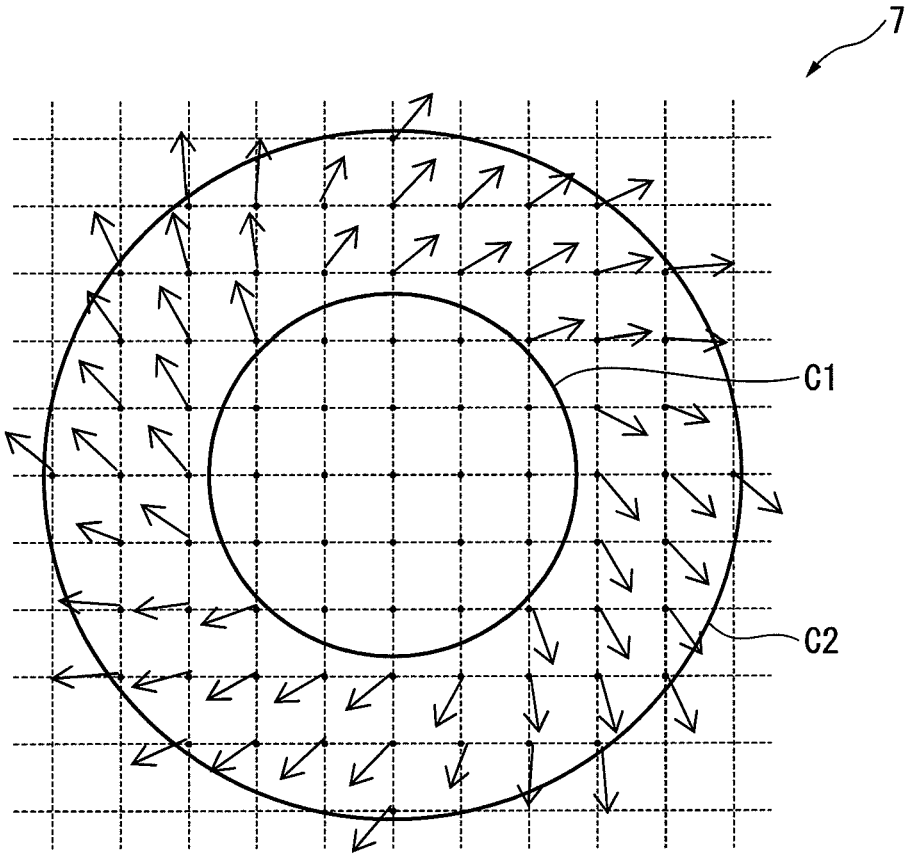

FIG. 8 is an image view showing the diffusion state of the grinding fluid in Example 3.

DESCRIPTION OF EMBODIMENT(S)

An exemplary embodiment of the invention will be described below with reference to the attached drawings.

Arrangement of Double-Head Grinding Machine

Figure 1:
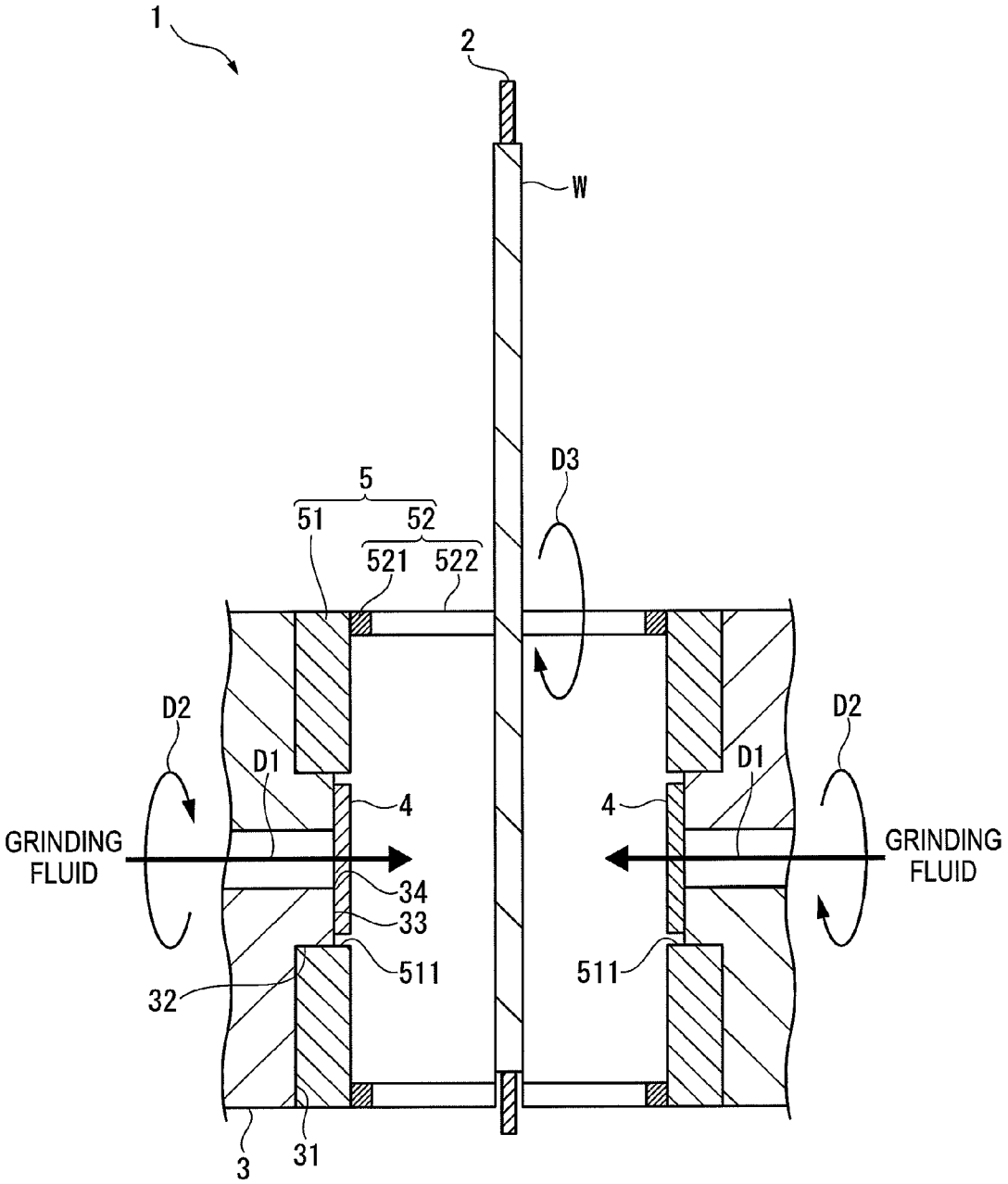
FIG. 1 is a sectional view schematically showing an arrangement of a double-head grinding machine provided with a diffusion plate according to an exemplary embodiment.

As shown in FIG. 1, a double-head grinding machine 1 (a grinding machine) includes a carrier ring 2 that holds a wafer W (a workpiece) therein, a supply pipe 3, a diffusion plate 4 that diffuses a grinding fluid (a supply fluid) supplied through the supply pipe 3, a grinding wheel 5 that grinds the wafer W using the grinding fluid diffused by the diffusion plate 4, a grinding fluid delivering unit for delivering the grinding fluid to the supply pipe 3 (not shown), and a grinding mechanism for driving the grinding wheel 5 to grind the wafer W (not shown)

The supply pipe 3 faces each surface of the wafer W held by the carrier ring 2. A protrusion 32 is provided to a first end surface 31 of the supply pipe 3 defined in a supply direction D1 of the grinding fluid. It should be noted that the supply pipe 3 may include a substantially disc-shaped flange with an end that includes the protrusion 32, and a pipe attached with the flange.

Figure 2:
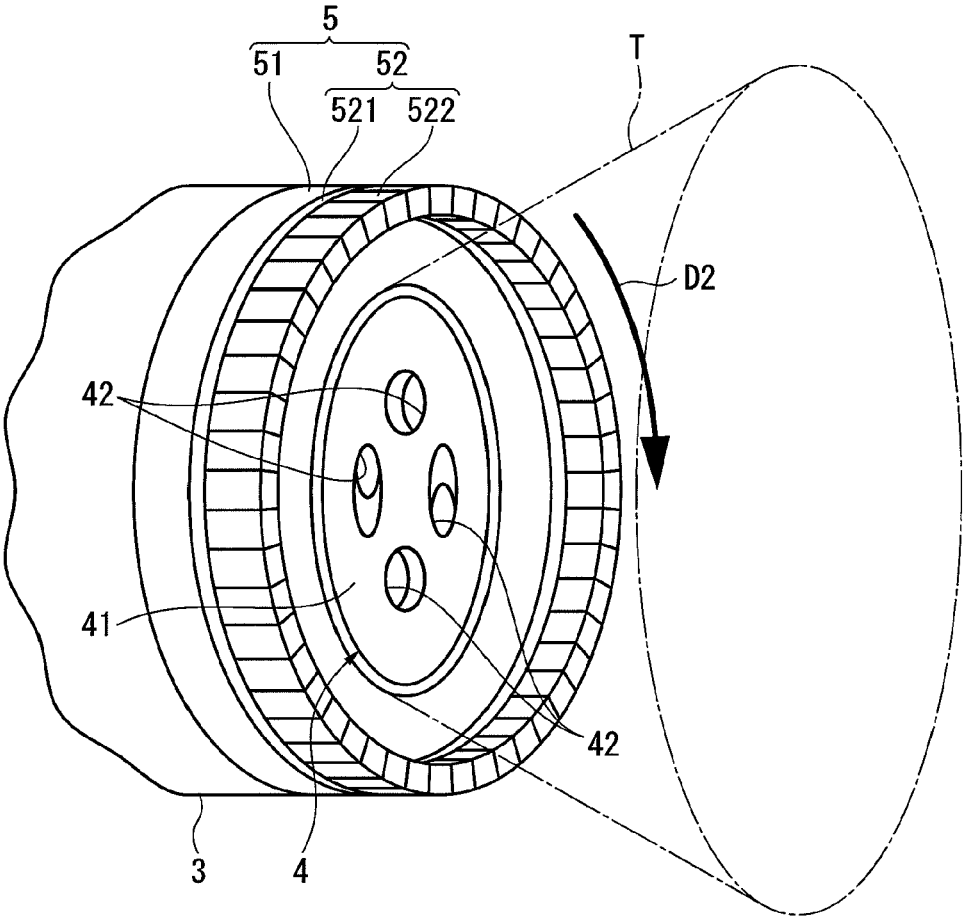
FIG. 2 is a perspective view showing a relevant part of the double-head grinding machine.

As shown in FIGS. 1 and 2, the grinding wheel 5 includes a substantially disc-shaped wheel base 51 such as a diamond wheel, and a grinding stone 52.

The wheel base 51 has a positioning hole 511 at the center thereof, the positioning hole 511 penetrating the wheel base 51 from front to back. The protrusion 32 of the supply pipe 3 is fitted in the positioning hole 511. The wheel base 51 is thus brought into close contact with the first end surface 31 of the supply pipe 3, and fixed with a thickness direction of the wheel base 51 being substantially parallel with the supply direction D1 of the grinding fluid. The wheel base 51 is rotatable in a rotation direction D2 around a rotation axis substantially parallel with the thickness direction along with the supply pipe 3.

The grinding stone 52, which annularly projects from a non-facing surface of the wheel base 51 not facing the supply pipe 3, is to be pressed against the wafer W. The grinding stone 52 includes an annular grinding base 521, and a plurality of chips 522 arranged along an outer circumferential direction of the grinding base 521.

The chips 522 are each in the shape of a rectangular plate. Adjacent ones of the chips 522 are arranged at desired intervals. Thus, an inter-chip slit is defined between the grinding base 521 and adjacent ones of the chips 522, the inter-chip slit having a width equal to the intervals between the chips irrespective of a level of the chips 522.

Figure 3A:
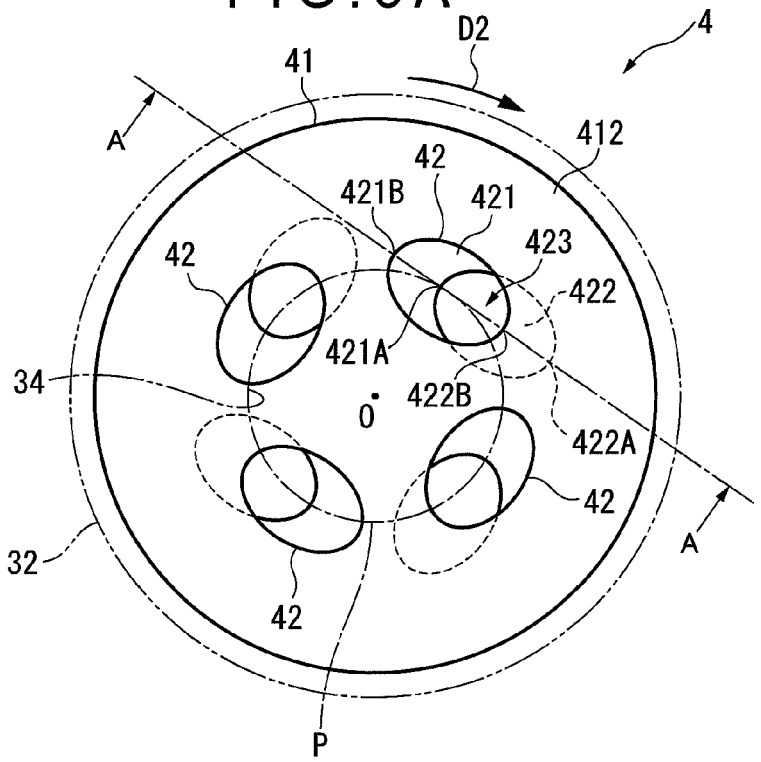
FIG. 3A is a plan view schematically showing an arrangement of the diffusion plate.
Figure 3B:
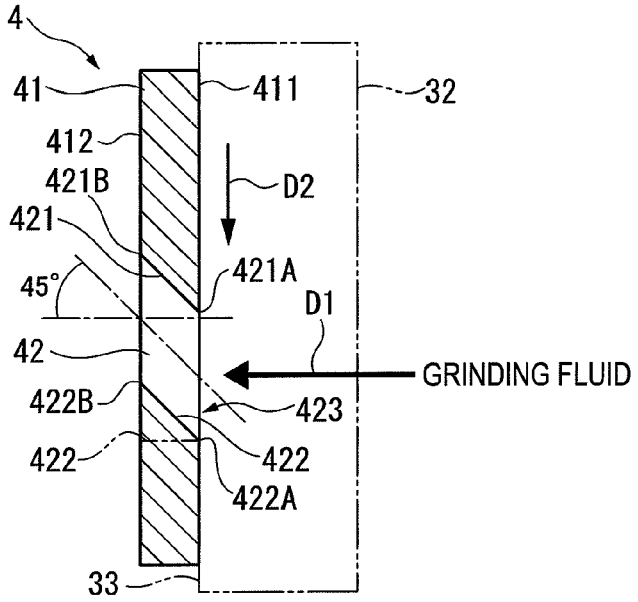
FIG. 3B is a sectional view taken along a line A-A in FIG. 3A.

As shown in FIGS. 2, 3A and 3B, the diffusion plate 4 includes a substantially disc-shaped plate member 41. The plate member 41 is in close contact with a second end surface 33 of the protrusion 32 (i.e., an opening end of the supply pipe 3), and fixed with a thickness direction of the plate member 41 being substantially parallel with the supply direction Dl of the grinding fluid. The plate member 41 is rotatable in the rotation direction D2 around the rotation axis substantially parallel with the thickness direction along with the supply pipe 3 and the grinding wheel 5.

The plate member 41 is provided with a plurality of diffusion holes 42 arranged at positions except a rotation center O of the plate member 41. The diffusion holes 42, through which the grinding fluid is to be passed, penetrate in the thickness direction. It should be noted that four diffusion holes 42 in the same shape are provided in the exemplary embodiment.

The plurality of diffusion holes 42 are arranged at regular intervals (90-degree intervals) on a circumference of an imaginary circle P around the rotation center O of the plate member 41. It should be noted that the imaginary circle P coincides with an opening edge 34 of the supply pipe 3 in the exemplary embodiment.

The diffusion holes 42 each define a first wall surface 421 defined at a rear side in the rotation direction D2 and a second wall surface 422 defined at a front side in the rotation direction D2. The first wall surface 421 has a wall surface end 421A defined in a facing surface 411 of the plate member 41, which faces the supply pipe 31, at the rearmost in the rotation direction, and a wall surface end 421B defined in a non-facing surface 412 of the plate member 41 at the rearmost in the rotation direction. The first wall surface 421 is inclined relative to the facing surface 411 with the wall surface end 421A being at a front side of the wall surface end 421 B in the rotation direction D2. The second wall surface 422 has a wall surface end 422A defined in the facing surface 411 at the forefront in the rotation direction, and a wall surface end 422B defined in the non-facing surface 412 at the forefront in the rotation direction. The second wall surface 422 is inclined relative to the facing surface 411 with the wall surface end 422A being at a front side of the wall surface end 422B in the rotation direction D2.

The diffusion holes 42 each also have an opening 423 defined in the facing surface 411, and the opening edge 34 of the supply pipe 3 overlaps with the opening 423.

An inclination of each of the first and second wall surfaces 421, 422 may be adjusted as needed in accordance with, for instance, a diameter of the wafer W and/or the arrangement of the grinding wheel 5, but is desirably in a range from 30 degrees to 60 degrees relative to the facing surface 411 of the plate member 41, particularly preferably 45 degrees.

It should be noted that such diffusion holes 42 may be made by obliquely piercing the facing surface 411 with a tool such as a drill. Each of the diffusion holes 42 thus has a cross section in the shape of a true circle orthogonal to a center axis thereof.

A diffusion direction of the grinding fluid may be adjusted by adjusting a thickness of the diffusion plate 4. It should be noted that when the thickness of the diffusion plate 4 is excessively reduced or increased, it may be difficult to diffuse the grinding fluid in a desired direction. Specifically, an excessive reduction in the thickness of the diffusion plate 4 results in an excessive reduction in a level of the first wall surface 421, so that the grinding fluid is weakly diffused. In contrast, an excessive increase in the thickness of the diffusion plate 4 results in an excessive increase in the level of the first surface 421, so that the grinding fluid is diffused more forcefully than necessary. Accordingly, the thickness of the diffusion plate 4 needs to be appropriately adjusted in accordance with, for instance, a diameter of the opening edge 34 of the supply pipe 3, a diameter and positions of the diffusion holes 42 of the diffusion plate 4, and/or a supply flow rate of the grinding fluid.

The grinding mechanism rotates the grinding wheel 5 at each side of the vertically set wafer W, and presses the grinding stone 52 against the wafer W at or below a center of the wafer W. Further, while the grinding stone 52 is pressed, the grinding fluid is supplied into the grinding wheel 5 and, simultaneously, the wafer W is rotated. The wafer W is thus ground.

Double-Head Grinding Method

Next, a double-head grinding method using the double-head grinding machine 1 including the diffusion plate 4 will be described.

As shown in FIG. 1, the grinding wheel 5, which includes two grinding wheels, is attached to the double-head grinding machine 1. While pressing the grinding wheel 5 against each side of the wafer W, the double-head grinding machine 1 supplies the grinding fluid into the grinding wheel 5. Further, while rotating the supply pipe 3, the diffusion plate 4 and the grinding wheel 5 in the rotation direction D2, the double-head grinding machine 1 rotates the wafer W, which is held by the carrier ring 2, in a rotation direction D3, thereby grinding the wafer W. The thus-ground wafer W is then replaced by an unprocessed wafer W, and the grinding process is repeated.

The grinding fluid is not particularly limited, but may be water, a water-soluble grinding fluid, a water-insoluble grinding fluid, or an emulsified oil.

The supply flow rate of the grinding fluid per each grinding wheel 5 is preferably 1.3 L/min or more. When the supply flow rate of the grinding fluid is less than 1.3 L/min, a diffusion distance of the grinding fluid in the supply direction D1 is unlikely to be increased.

A rotation speed of the grinding wheel 5 is preferably in a range from 4500 rpm to 5500 rpm. When the rotation speed of the grinding wheel 5 is less than 4500 rpm, the diffusion distance of the grinding fluid in the supply direction D1 is unlikely to be increased.

In grinding, when the grinding fluid is delivered to the supply pipe rotated in the rotation direction D2, the grinding fluid receives a centrifugal force of the rotation of the supply pipe 3. The grinding fluid is thus directed toward the opening edge 34 of the supply pipe 3 while pressed against an inner wall surface of the supply pipe 3. Since the opening edge 34 overlaps with the opening 423 of each of the diffusion holes 42 defined in the facing surface 411, the grinding fluid having been pressed against the inner wall surface of the supply pipe 3 can enter each of the diffusion holes 42 through the opening edge 34 and the opening 423 without being left in the supply pipe 3. When passing through the opening edge 34, the grinding fluid receives a force in a tangent direction of the opening 34 substantially parallel with the rotation direction D2. A combination of the force in the tangent direction of the opening edge 34 and a force in the supply direction D1 allows the grinding fluid to enter each of the diffusion holes 42 of the diffusion plate 4 while moving obliquely relative to the second end surface 33 of the protrusion 32.

When entering each of the diffusion holes 42, the grinding fluid comes into contact with the first wall surface 421 at the rear side in the rotation direction D2. As the inclined first wall surface 421 is moved forward in the rotation direction D2 (downward in FIG. 3B), the force in the supply direction D1 is inferred to be applied to the grinding fluid. Therefore, as compared with an instance in which the first wall surface 421 is not inclined in the same manner as described above, the diffusion distance of the grinding fluid in the supply direction D1 is increased. A sufficient amount of the grinding fluid can thus be supplied to the wafer W even when the grinding stone 52 of the grinding wheel 5 is still unworn with a large height.

When entering each of the diffusion holes 42, the grinding fluid is directed rearward in the rotation direction D2 due to the inclination of the second wall surface 422 at the front side in the rotation direction D2. As the first wall surface 421 is moved in the rotation direction D2, the force in the supply direction D1 is inferred to be applied to the grinding fluid having been directed rearward in the rotation direction D2 as described above. Therefore, as compared with an instance in which the diffusion holes 42 each have no second wall surface 422, the diffusion distance of the grinding fluid in the supply direction D1 is further increased.

Further, since the plurality of diffusion holes 42 are arranged at regular intervals on the circumference of the imaginary circle P, the grinding fluid is evenly diffused in any circumferential direction along a diffusion locus T substantially in the shape of a circular truncated cone as shown by chain lines in FIG. 2.

The wafer W is thus ground by the grinding wheel 5 while being supplied with a sufficient amount of the grinding fluid evenly diffused by the diffusion plate 4.

It should be noted that a wear volume of the grinding stone 52 (a grinding stone wear volume) may be measured every time when the grinding process is performed to evaluate a ground state based on a variation in the grinding stone wear volume before and after the grinding process. The variation is preferably kept 20% or less throughout a grinding stone lifetime. Specifically, the grinding stone wear volume is preferably in a range from 1.5 μm per wafer to 1.8 μm per wafer.

The ground wafer W may be evaluated based on a variation in Bow (the direction and/or magnitude of the warpage of the wafer W) before and after grinding of the wafer W. A value of Bow is an index for a balance between damages of the front and rear surfaces or residual stresses resulting therefrom. As a variation in Bow before and after the grinding process approaches zero, the damages (residual stresses) of the front and rear surfaces are becoming equal. It means that the respective ground states of the front and rear surfaces are equal.

Here, Bow, which is an index for the warpage of the entire wafer, is defined as a deviation between a median reference plane of the wafer and a median surface at the center point of the wafer, the median reference plane being defined by three points on the median surface (Bow-3P) or a best-fit (Bow-bf) reference. Therefore, a positive (+) value of Bow means a convex warpage, and a negative (−) value of Bow means a concave warpage. For instance, a warpage may be measured using an optical-sensor-type flatness measuring device (Wafercom, manufactured by LapmasterSFT Corp.).

A deviation of a value of Bow measured after the grinding of the wafer W from a value of Bow measured before the grinding of the wafer W is preferably in a range from −10 μm to +10 μm.

Advantage(s) of Exemplary Embodiment(s)

The above exemplary embodiment provides the following advantages (1) to (5).

(1) The diffusion holes 42 of the diffusion plate 4 each have the first wall surface 421 defined at the rear side in the rotation direction D2, the first wall surface 421 being inclined such that the wall surface end 421A thereof defined in the facing surface 411 at the rearmost in the rotation direction is at the front side of the wall surface end 421B defined in the non-facing surface 412 at the rearmost in the rotation direction.

Consequently, as the first wall surface 421 is moved in the rotation direction D2, the force in the supply direction D1 is applied to the grinding fluid to increase the diffusion distance of the grinding fluid in the supply direction D1, as described above. The diffusion distance of the grinding fluid in the supply direction D1 can thus be increased simply by inclining the first wall surface 421 as described above without the necessity of adjusting the supply flow rate of the grinding fluid.

Further, a required amount of the grinding fluid can be supplied to the wafer W irrespective of whether or not the height of the grinding stone 52 of the grinding wheel 5 is large, thereby preventing an increase in the grinding stone wear volume per wafer. Thus, the lifetime of the grinding wheel 5 can be increased, and the quality of the ground wafer W can be maintained.

Further, the grinding fluid can reliably reach the wafer W without the necessity of adjusting the supply flow rate of the grinding fluid irrespective of whether or not the height of the grinding stone 52 is large, thereby saving the grinding fluid and reducing production costs.

Additionally, since the diffused grinding fluid can directly reach the wafer W, the ground surface of the wafer W can be washed with it.

(2) The diffusion holes 42 of the diffusion plate 4 each have the second wall surface 422 defined at the front side in the rotation direction D2, the second wall surface 422 being inclined such that the wall surface end 422A thereof defined in the facing surface 411 at the forefront in the rotation direction is at the front side of the wall surface end 422B defined in the non-facing surface 412 at the forefront in the rotation direction.

Thus, the grinding fluid can be directed rearward in the rotation direction D2 due to the inclination of the second wall surface 422, thereby increasing an amount of the grinding fluid receiving a force in an ejection direction to increase the diffusion distance of the grinding fluid in the ejection direction. Therefore, an amount of the grinding fluid reaching the ground surface of the wafer W can be increased to perform a grinding process with a stable quality.

(3) The plurality of diffusion holes 42 are arranged at regular intervals on the circumference of the imaginary circle P of the plate member 41.

The grinding fluid can thus be evenly diffused in any circumferential direction to prevent uneven grinding.

(4) The diffusion holes 42 each have the opening 423 defined in the facing surface 411, and the opening edge 34 of the supply pipe 3 overlaps with the opening 423.

Thus, the grinding fluid, which is pressed against the inner wall surface of the supply pipe 3 by the rotation of the supply pipe 3, can be directed into each of the diffusion holes 42 through the opening edge 34 and the opening 423 without being left in the supply pipe 3, thereby suppressing a reduction in a diffusion amount of the grinding fluid.

(5) The diffusion plate 4 is independent of the grinding wheel 5.

Thus, the above advantages can be achieved simply by attaching the diffusion plate 4 to a typical double-head grinding machine. Further, each of the diffusion plate 4 and the grinding wheel 5 can be easily independently replaced or subjected to maintenance.

Other Exemplary Embodiment(s)

It should be noted that the invention is not limited to the above exemplary embodiment, but may include a variety of improvements or design changes compatible with the invention.

Figure 4:
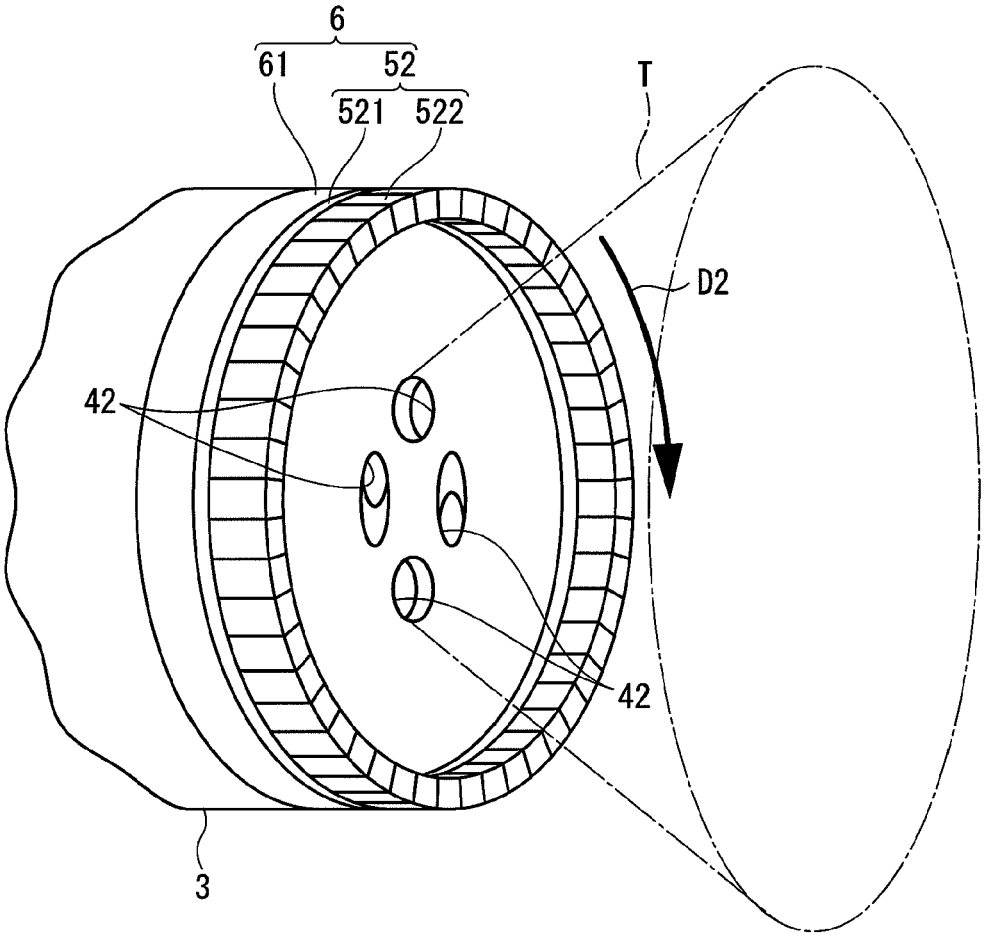
FIG. 4 is a perspective view showing a grinding wheel according to a modification of the invention.

For instance, the diffusion plate 4 and the grinding wheel 5 are independent of each other in the exemplary embodiment, but may be integral with each other as shown in FIG. 4.

As shown in FIG. 4, a grinding wheel 6 includes, for instance, a substantially disc-shaped wheel base 61 (a diamond wheel), and the grinding stone 52. The wheel base 61 is provided with diffusion holes 42 arranged at four positions except a rotation center of the wheel base 61. The diffusion holes 42 are the same in shape as those of the diffusion plate 4 of the above exemplary embodiment.

When the grinding wheel 6 is provided with the diffusion holes 42, the grinding wheel 6 can be easily detached/attached for replacement or maintenance in addition to the advantages of the above exemplary embodiment.

Although the supply pipe 3 consists of a single pipe in the above exemplary embodiment, the supply pipe 3 may include a plurality of pipes, the number of which corresponds to that of the diffusion holes 42 of the diffusion plate 4.

Further, the number of the diffusion holes 42 may be in range from one to three, or may alternatively be four or more.

The four diffusion holes 42 may be different from one another in shape, and the shape of the cross section of each of the diffusion holes 42 may be not a true circle but an oval or a polygon.

The second wall surface 422 of each of the diffusion holes 42 may be orthogonal to the facing surface 411 as shown by a chain double-dashed line in FIG. 3B instead of being inclined relative to the facing surface 411.

The opening 423 of each of the diffusion holes 42 defined in the facing surface 411 may be entirely present in the opening of the supply pipe 3 without any overlap of the opening edge of each of the diffusion holes 42 defined in the facing surface 411 with the opening edge of the supply pipe 3.

In the above exemplary embodiment, the grinding machine is exemplified by the double-head grinding machine 1 configured to simultaneously grind both surfaces of the wafer W that is vertically set. However, the grinding machine may be a horizontal double-head grinding machine configured to simultaneously grind both surfaces of the wafer W that is horizontally set. The grinding machine may be a single-side grinding machine configured to grind only a single surface of the wafer W.

The supply fluid is not limited to the grinding fluid as long as it can be supplied through the supply pipe 3, and any fluid for, for instance, washing and/or chemical reaction is usable. A fluid to be supplied with the supply fluid may be, for instance, a plate-shaped or block-shaped solid body, which is to be, for instance, washed and/or subjected to a chemical reaction with the supply fluid.

Only the diffusion plate 4 and the grinding wheel 5 may be rotated without rotating the supply pipe 3. The respective rotation directions and speeds of the supply pipe 3, the diffusion plate 4 and the grinding wheel 5 may be different.

EXAMPLE(S)

Next, the invention is described in further detail with reference to Example(s) and Comparative Example(s), which by no means limit the invention.

Example 1

In Example 1, the double-head grinding machine 1 including the diffusion plate 4 of the exemplary embodiment was used, and a wafer W was ground with the grinding fluid diffused by the diffusion plate 4. It should be noted that grinding conditions were as follows: the height of the chips 522 of the grinding stone 52 (chip height)=15 mm; and the supply flow rate of the grinding fluid=1.6 L/min (constant).

In Comparative Example 1, the diffusion plate 4 was removed from the double-head grinding machine 1 of the exemplary embodiment, and a wafer W was ground under the same grinding conditions as those of Example 1 without diffusing the grinding fluid supplied through the supply pipe 3 using the diffusion plate 4.

Figure 5:
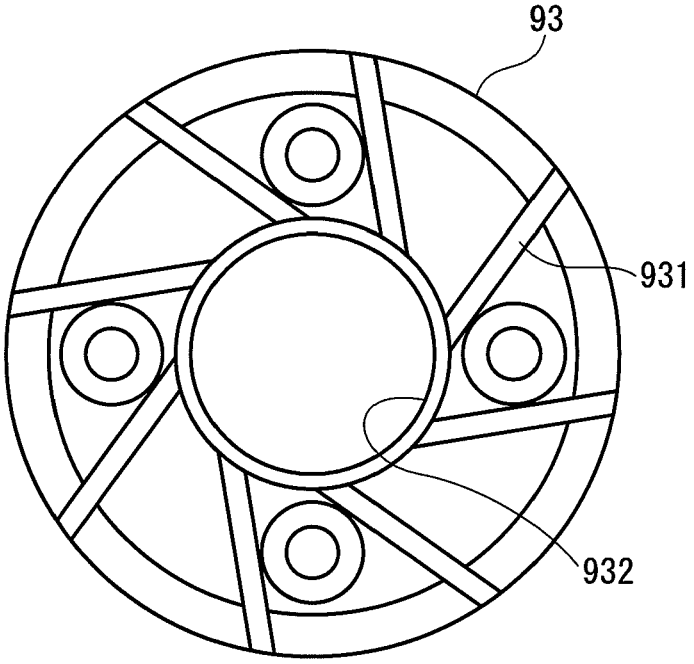
FIG. 5 is a plan view schematically showing an arrangement of a diffusion plate provided with impellers of Comparative Example 2.

In Comparative Example 2, the supply pipe 3 was attached with a diffusion plate 93 including impellers 931 and a through-hole 932 substantially in the same shape as that of the opening edge 34 of the supply pipe 3 as shown in FIG. 5 in place of the diffusion plate 4. A wafer W was ground using the grinding fluid diffused by the diffusion plate 93 under the same conditions as those of Example 1.

The respective profiles of the ground wafers W of Example 1 and Comparative Examples 1 and 2 were measured in terms of Bow. Further, after the grinding of the single wafer W under the conditions of each of Example 1 and Comparative Examples 1 and 2, the chip height of the grinding stone 52 was measured to obtain a grinding stone wear volume.

The grinding stone wear volume and Bow-bf of Example 1 were respectively 1.36 μm and 6.14 μm. In contrast, the grinding stone wear volume and Bow-bf of Comparative Example 1 were respectively 2.16 μm and −18.7 μm, and the grinding stone wear volume and Bow-bf of Comparative Example 2 were respectively 2.08 μm and −20.1 μm.

The results showing that Example 1 achieves a small grinding stone wear volume and a Bow value of the ground wafer W of less than 10 μm have proven that a sufficient amount of the grinding fluid reaches the ground surface of the wafer W. In contrast, it is inferred that an amount of the grinding fluid supplied to the ground surface of the wafer W of each of Comparative Examples 1 and 2 is insufficient, and thus the grinding stone wear volume is increased to cause the warpage of the ground wafer W.

Example 2

In Example 2, the double-head grinding machine 1 including the diffusion plate 4 of the exemplary embodiment was used, and a plurality of wafers W were ground with the grinding fluid diffused by the diffusion plate 4. After the grinding of each of the wafers W, the resulting chip height and wear rate (a wear volume per wafer) were obtained.

Figure 6:
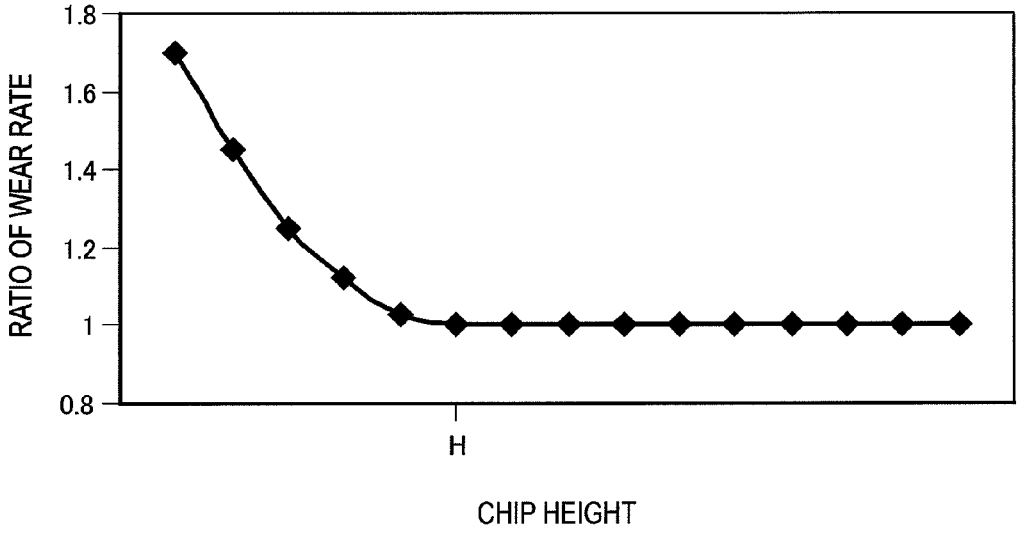
FIG. 6 is a graph showing a relationship between a chip height and a ratio of wear rate.

In Comparative Example 3, a plurality of wafers W were ground in the same manner as in Example 2 except that the diffusion plate 93 shown in FIG. 5 was attached in placed of the diffusion plate 4. After the grinding of each of the wafers W, the resulting chip height and wear rate were obtained FIG. 6 shows a relationship between a ratio of wear rate and a chip height based on the obtained results. It should be noted that an ordinate axis in FIG. 6 shows a ratio of the wear rate of Comparative Example 3 to that of Example 2.

FIG. 6 shows that when the chip height falls below a height H (i.e., values of the chip height at the right side of H), the ratio of wear rate is approximately one, which means that the wear rate of Example 2 is substantially the same as that of Comparative Example 3. In contrast, as the chip height gradually increases from the height H (i.e., values of the chip height gradually distanced leftward from H), the ratio of wear rate tends to be ever increasing from one.

Further, a relationship between Example 1 and Comparative Example 2 has proven that the use of the diffusion plate 93 shown in FIG. 5 leads to an increase in the grinding stone wear volume when the chip height is large.

Thus, it has been found that while the wear rate of Comparative Example 3 tends to increase with an increase in the chip height, the wear rate of Example 2 does not significantly vary even when the chip height is large.

Example 3

To demonstrate a diffusion state of the grinding fluid diffused by the diffusion plate 4 according to the invention, a glass plate 7 was set in the double-head grinding machine 1 including the diffusion plate 4 of the exemplary embodiment at a position distanced from the chips 522 of the grinding wheel 5 by 0.1 mm, as shown in FIG. 7. The thus-set glass plate 7 was transparent. Further, as shown in an upside of FIG. 7, the glass plate 7 was graduated at predetermined intervals to clearly show the diffusion state of the grinding fluid. The diffusion state of the grinding fluid, which is diffused by the diffusion plate 4 to reach the wafer W when the double-head grinding machine 1 is driven as in the exemplary embodiment, can thus be seen through the glass plate 7.

FIG. 8 shows the diffusion state of the grinding fluid diffused by the diffusion plate 4 seen through the glass plate 7. It should be noted that an inner circle C1 shown in FIG. 8 is an area where no grinding water reaches, and an outer circle C2 shown in FIG. 8 is an area where the chips 522 of the grinding stone 52 are brought into contact with the wafer W in grinding. Arrows show spreading directions of the grinding fluid having reached the glass plate 7.

It has been demonstrated that the grinding fluid diffused by the diffusion plate 4 is splashed on the glass plate 7 near an outer periphery of the circle C1, and flows outward from the rotation center while swirling in the directions indicated by the arrows, as shown in FIG. 8. The circle C1 where no grinding fluid reaches is defined at the inside of the circle C2 where the chips 522 are brought into contact with the wafer W. Thus, it has been found that the diffused grinding fluid sufficiently spreads over the area where the chips 522 of the grinding stone 52 are brought into contact with the wafer W.

The invention claimed is:

1. A diffusion plate that diffuses a supply fluid supplied through a supply pipe, the diffusion plate comprising a plate member configured to face an opening end of the supply pipe with a thickness direction of the plate member being substantially parallel with a supply direction of the supply fluid, the plate member being rotatable around a rotation axis substantially parallel with the thickness direction, wherein the plate member is provided with a plurality of diffusion holes through which the supply fluid is to be passed, each of the plurality of diffusion holes penetrating in the thickness direction at a position other than a rotation center of the plate member, each of the plurality of diffusion holes having a first wall surface defined at a rear side in a rotation direction of the plate member, the first wall surface having a rear first wall surface end defined in a facing surface of the plate member, which faces the supply pipe, at a rearmost in the rotation direction and a rear second wall surface end defined in a non-facing surface of the plate member at a rearmost in the rotation direction, the first wall surface is inclined with the rear first wall surface end being at a front side of the rear second wall surface end in the rotation direction, wherein the plurality of diffusion holes are positioned at regular intervals on a circumference of an imaginary circle that is defined around the rotation center of the plate member, wherein the circumference of the imaginary circle coincides with an opening edge of the supply pipe.

2. The diffusion plate according to claim 1, wherein each of the plurality of diffusion holes have a second wall surface defined at a front side in the rotation direction, the second wall surface having a front first wall surface end defined in the facing surface at a forefront in the rotation direction and a front second wall surface end defined in the non-facing surface at a forefront in the rotation direction, and the second wall surface is inclined with the front first wall surface end being at a front side of the front second wall surface end in the rotation direction.

3. A grinding wheel that grinds a workpiece using a grinding fluid supplied through a supply pipe, the grinding wheel comprising:

a substantially plate-shaped wheel base configured to face an opening end of the supply pipe with a thickness direction of the wheel base being substantially parallel with a supply direction of the grinding fluid, the wheel base being rotatable around a rotation axis substantially parallel with the thickness direction; and a grinding stone annularly projecting from a non-facing surface of the wheel base configured not to face the supply pipe, the grinding stone being configured to be pressed against the workpiece, wherein the wheel base is provided with a plurality of diffusion holes through which the grinding fluid is to be passed, each of the plurality of diffusion holes penetrating in the thickness direction at a position other than a rotation center of the wheel base, each of the plurality of diffusion holes having a wall surface defined at a rear side in a rotation direction of the wheel base, the wall surface having a rear first wall surface end defined in a facing surface of the wheel base, which faces the supply pipe, at a rearmost in the rotation direction and a rear second wall surface end defined in the non-facing surface of the wheel base at a rearmost in the rotation direction, the wall surface is inclined with the rear first wall surface end being at a front side of the rear second wall surface end in the rotation direction, wherein the plurality of diffusion holes are positioned at regular intervals on a circumference of an imaginary circle that is defined around the rotation center of the wheel base, wherein the circumference of the imaginary circle coincides with an opening edge of the supply pipe.

4. A grinding machine comprising:

a supply pipe;

the diffusion plate according to claim 1 that diffuses a grinding fluid supplied through the supply pipe; and a grinding wheel that grinds a workpiece using the grinding fluid diffused by the diffusion plate.

5. A grinding machine comprising:

a supply pipe; and the grinding wheel according to claim 3 that grinds a workpiece using a grinding fluid supplied through the supply pipe.

* * * * *